US006666176B2

(12) United States Patent
Shinpo et al.

(10) Patent No.: US 6,666,176 B2
(45) Date of Patent: Dec. 23, 2003

(54) ENGINE COOLING SYSTEM

(75) Inventors: Yoshikazu Shinpo, Nissin (JP); Shigetaka Yoshikawa, Aichi-ken (JP); Isao Takagi, Okazaki (JP); Daisuke Yamamoto, Obu (JP); Hiromichi Murakami, Obu (JP)

(73) Assignees: Toyota Jidosha Kabushiki Kaisha, Toyota (JP); Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/200,229

(22) Filed: Jul. 23, 2002

(65) Prior Publication Data

US 2003/0019441 A1 Jan. 30, 2003

(30) Foreign Application Priority Data

Jul. 25, 2001 (JP) ..... 2001-224669

(51) Int. Cl.[7] ..... F01P 7/14

(52) U.S. Cl. ..... 123/41.1; 236/34.5; 123/41.58; 123/41.15

(58) Field of Search ..... 123/41.1, 41.15, 123/41.58, 41.57, 198 D; 236/34.5

(56) References Cited

U.S. PATENT DOCUMENTS 3,907,199 A * 9/1975 Kreger ..... 237/12.3 B
5,529,026 A * 6/1996 Kurr et al. ..... 123/41.1

FOREIGN PATENT DOCUMENTS

JP A 10-317965 12/1998

* cited by examiner

*Primary Examiner*—Tony M. Argenbright
*Assistant Examiner*—Katrina B. Harris
(74) *Attorney, Agent, or Firm*—Oliff & Berridge, PLC

(57) ABSTRACT

A flow control valve is located in a coolant circuit that extends through an engine. The flow control valve is operated in accordance with a control mode selected from a full closing control mode, a full opening control mode, and a feedback control mode. When switching from one control mode to another, the flow control valve is controlled in accordance with a transitional control procedure selected from different types of transitional control procedures. The transitional control procedure to be performed is selected depending on which control modes are performed before and after the control mode switching and/or the current condition of the engine. Transitional controlling of the flow control valve is thus appropriately conducted.

26 Claims, 4 Drawing Sheets

Fig.4(a)
Fig.4(b)
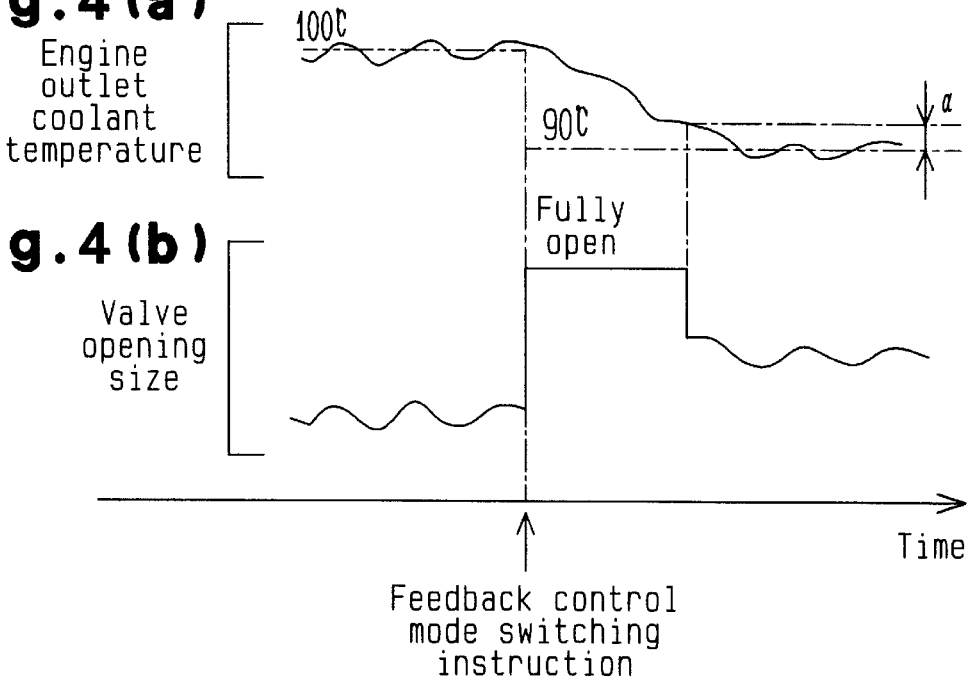
Fig.5(a)
Fig.5(b)
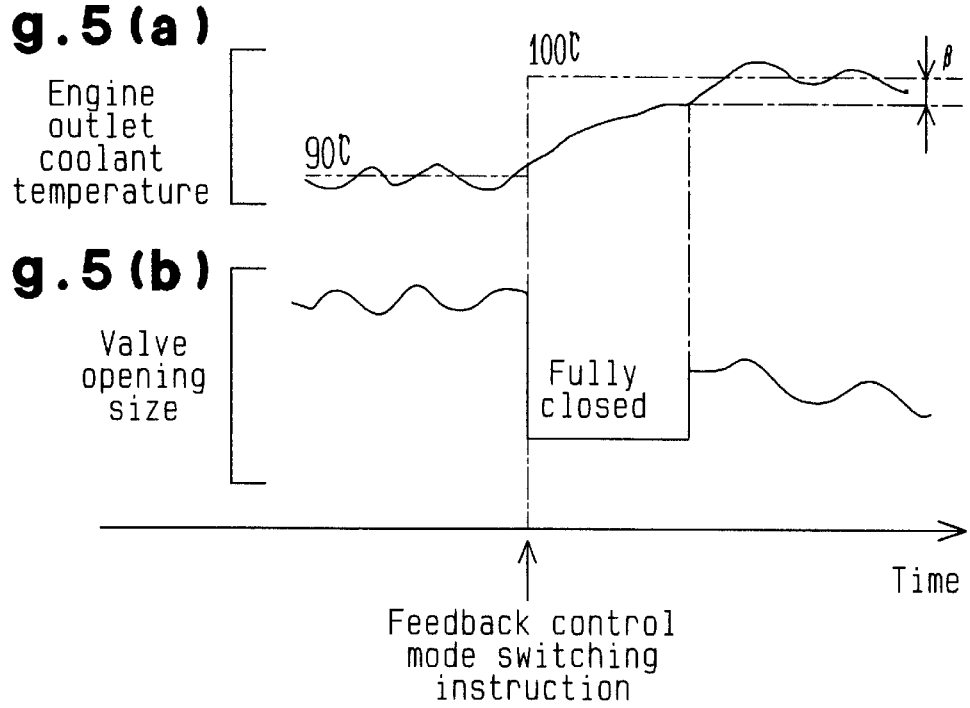

ENGINE COOLING SYSTEM

BACKGROUND OF THE INVENTION

The present invention relates to engine cooling systems.

Generally, a water cooling type engine of a vehicle includes a cooling system provided with a radiator and a flow control valve. The radiator is located in an engine coolant circuit for cooling the coolant. The flow control valve regulates the flow of the coolant that passes through the radiator. The flow control valve is controlled to change the coolant flow in the radiator (hereafter, "the radiator flow"). This adjusts the temperature of the coolant, which cools the engine.

For example, Japanese Laid-Open Patent No. 10-317965 describes a known control procedure of the flow control valve. According to the procedure, the flow control valve is fully closed to minimize the radiator flow when the coolant temperature is relatively low. In contrast, when the coolant temperature is relatively high, the flow control valve is fully opened to maximize the radiator flow. Otherwise, a feedback control procedure is performed to vary the opening size of the flow control valve (the radiator flow) depending on the coolant temperature, such that the coolant temperature seeks a predetermined target.

In other words, the control state of the flow control valve is changed, as needed, among a fully closed state, a fully open state, and a feedback control state. This controls the coolant temperature appropriately.

When the control state of the flow control valve is being changed from one state to another, the flow control valve is being subjected to transitional controlling. If the transitional controlling is inappropriate, a certain problem may occur. It is thus important to optimize the transitional controlling to ensure that the transitional controlling is conducted appropriately. However, switching of the control states of the flow control valve involves various different modes and purposes. This makes it difficult to perform the transitional controlling always reliably for meeting the requirements of a certain mode or achieving a certain purpose.

BRIEF SUMMARY OF THE INVENTION

Accordingly, it is an objective of the present invention to provide an engine cooling system that appropriately performs transitional controlling of a flow control valve when changing the control mode of the flow control mode from one mode to another.

To achieve the foregoing and other objectives and in accordance with the purpose of the present invention, the invention provides an engine cooling system that includes a coolant circuit, which extends through an engine, a radiator, which is located in the coolant circuit and cools the coolant that flows in the coolant circuit, a flow control valve, which regulates the amount of the coolant that passes through the radiator, and a controller, which controls the flow control valve for adjusting the temperature of the coolant that flows in the engine. The controller controls the flow control valve in accordance with a control mode selected from different types of control modes. The controller performs a transitional control procedure selected from different types of transitional control procedures when switching from one control mode to another.

The present invention also provides a method for controlling an engine cooling system. The system includes a coolant circuit that extends through an engine. The method includes: cooling coolant that flows in the coolant circuit with a radiator located in the coolant circuit; regulating the amount of the coolant that passes through the radiator with a flow control valve; controlling the flow control valve in accordance with a control mode selected from different types of control modes; and controlling the flow control valve in accordance with a transitional control procedure selected from different types of transitional control procedures, when switching from one control mode to another.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objectives and advantages thereof, may best be understood by reference to the following description of the presently preferred embodiments together with the accompanying drawings in which:

FIGS. 4(*a*) and 4(*b*) are timing charts respectively indicating variation of the coolant temperature at an outlet from an engine and variation of the opening size of a flow control valve, when the control mode of the flow control valve is changed from a feedback control mode in which the target value is 100 degrees Celsius to a feedback control mode in which the target value is 90 degrees Celsius; and FIGS. 5(*a*) and 5(*b*) are timing charts respectively indicating variation of the coolant temperature at an outlet from the engine and variation of the opening size of a flow control valve, when the flow control valve is switched from the feedback control mode in which the target value is 90 degrees Celsius to the feedback control mode in which the target value is 100 degrees Celsius.

DETAILED DESCRIPTION OF THE PREFERRED EMBODIMENTS

An embodiment of the present invention applied to an automobile engine will now be described with reference to FIGS. 1 to 5(*b*).

Figure 1:
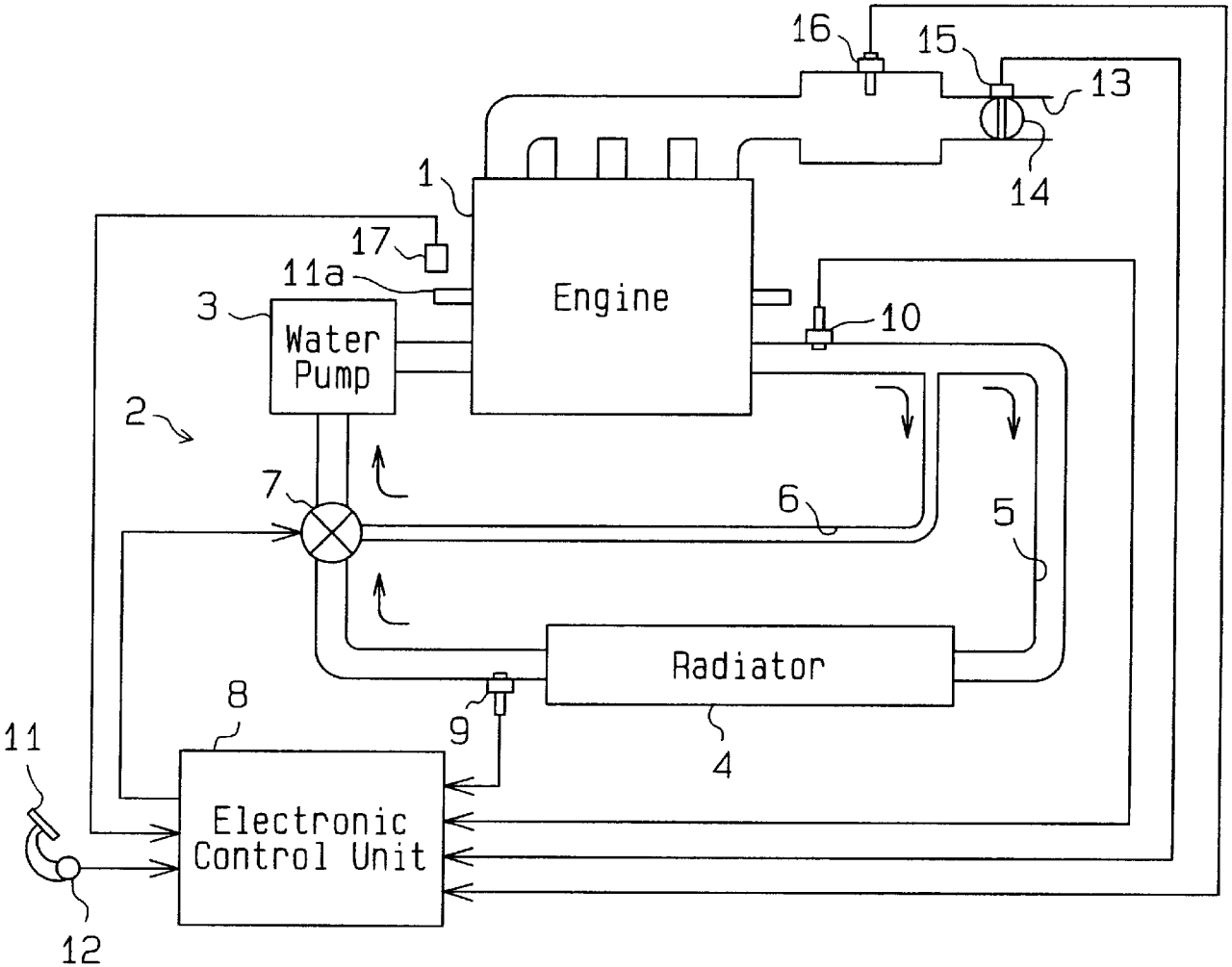
FIG. 1 is a view schematically showing the structure of an engine cooling system according to an embodiment of the present invention as a whole.

With reference to FIG. 1, a cooling system of an engine 1 includes a coolant circuit 2 for circulating coolant such that the coolant passes through the engine 1. The coolant circuit 2 includes a water pump 3. When the water pump 3 is activated, the coolant flows in the coolant circuit 2 in a rightward rotational direction, as viewed in the drawing. The coolant thus passes through a cylinder block and a cylinder head (neither is illustrated) of the engine 1. This transmits heat from the engine 1 to the coolant, thus cooling the engine 1.

The coolant circuit 2 has two branches downstream of the engine 1, which are merged into a single flow at a position upstream of the water pump 3. One of the branches forms a radiator line 5, and the other a bypass 6. The radiator line 5 sends coolant to a radiator 4 and recirculates the coolant to the engine 1 after the coolant is cooled by the radiator 4. The bypass 6 sends coolant to the engine 1 without passing the coolant through the radiator 4. A flow control valve 7 is formed at a position at which the radiator line 5 and the bypass 6 are merged into the single flow. The flow control valve 7 regulates the flow of the coolant in the radiator line 5 and the flow of the coolant in the bypass 6.

More specifically, the flow control valve 7 adjusts the coolant flow in the radiator line 5 to control the temperature of the coolant for cooling the engine 1 (the coolant flowing upstream of the engine 1 in the coolant circuit 2). In other words, if the coolant flow in the radiator 5 is increased, the proportion of the coolant cooled by the radiator 4 is raised, with respect to the total flow of the coolant that flows to the engine 1 in the coolant circuit 2. This lowers the temperature of the coolant that cools the engine 1. In contrast, if the coolant flow in the radiator 5 is decreased, the proportion of the coolant cooled by the radiator 4 is lowered, with respect to the total flow of the coolant that flows to the engine 1 in the coolant circuit 2. This raises the temperature of the coolant that cools the engine 1.

An electronic control unit 8, which is installed in the vehicle, drives and controls the flow control valve 7. The electronic control unit 8 receives detection signals from the following sensors:

- A radiator coolant temperature sensor 9 for detecting the coolant temperature downstream of the radiator 4 in the radiator line 5;
- An engine coolant temperature sensor 10 for detecting the coolant temperature at an outlet of the coolant circuit 2 from the engine 1;
- An accelerator position sensor 12 for detecting the depression amount of an accelerator pedal 11 (the accelerator depression amount), which is depressed by the vehicle's driver;
- A throttle position sensor 15 for detecting the opening size of a throttle valve 14 (the throttle opening size), which is located in an intake passage 13 of the engine 1;
- A vacuum sensor 16 for detecting the pressure downstream of the throttle position sensor 15 in the intake passage 13 (the intake pressure); and
- A crank position sensor 17 for outputting a signal reflecting rotation of a crankshaft 1*a*, or an output shaft of the engine 1.

The electronic control unit 8 operates the flow control valve 7 in accordance with a control mode selected from a full opening control mode, a full closing control mode, and different types of feedback control modes, depending on, for example, the condition of the engine 1 or whether or not the engine cooling system has a problem. The flow control valve 7 is configured to increase the coolant flow in the radiator line 5 as the opening size of the flow control valve 7 becomes gradually larger. Hereafter, the control modes of the flow control valve 7, which are the full opening control mode, the full closing control mode, and the feedback control modes, will be each described in detail.

[Full Opening Control Mode]

The control mode of the flow control valve 7 is changed to the full opening control mode, for example, immediately after the engine 1 is started or when a problem occurs in the engine cooling system. More specifically, if the engine 1 is stopped and restarted immediately afterwards, the temperature of the coolant flowing to the engine 1 may become excessively high. The flow control valve 7 is thus fully opened to suppress the excessive increase of the temperature of the coolant flowing to the engine 1. Further, if the engine cooling system has a problem, the temperature of the coolant flowing to the engine 1 may become excessively high. Thus, also in this case, the flow control valve 7 is fully opened state to maintain the temperature of the coolant flowing to the engine 1 at a relatively low level, thus suppressing the excessive increase of the temperature of the coolant flowing to the engine 1.

[Full Closing Control Mode]

The control mode of the flow control valve 7 is changed to the full closing control mode, for example, if the engine 1 is not sufficiently warmed up with the flow control valve 7 held in the full opening control mode immediately after the starting of the engine 1.

[Feedback Control Mode]

The control mode of the flow control valve 7 is changed to one of the feedback control modes, for example, when the coolant temperature at the outlet of the coolant circuit 2 from the engine 1 (hereafter, the engine output coolant temperature) rises to a predetermined value, for example, 80–100 degrees Celsius after the starting of the engine 1. The engine outlet coolant temperature is determined in accordance with a detection signal from the engine coolant temperature sensor 10. In each of the feedback control modes, the opening size of the flow control valve 7 is controlled in relation to an instructed opening size Afin, which is obtained by the following equation (1):

$$Afin = Abse + h \tag{1}$$

Afin: Instructed opening size

Abse: Basic instructed opening size h: Feedback correction value

In the equation (1), the basic instructed opening size Abse is computed based on the engine speed and the engine load. More specifically, the value Abse is a theoretical opening size of the flow control valve 7 that is needed for achieving the target value of the engine outlet coolant temperature in accordance with the current operation state of the engine 1.

The engine speed is determined based on a detection signal of the crank position sensor 17. The engine load is determined based on a parameter varied in relation to the engine speed and the air intake of the engine 1. The parameter may be the accelerator depression amount obtained from a detection signal of the accelerator position sensor 12, the throttle opening size obtained from a detection signal of the throttle position sensor 15, or the intake pressure obtained from a detection signal of the vacuum sensor 16.

Further, the feedback correction value h of the equation (1) is varied such that the engine outlet coolant temperature becomes close to the target value when the difference between the engine outlet coolant temperature and its target value is relatively large. The feedback correction value h is computed based on the temperature of the coolant that has passed through the radiator line 5 (the radiator outlet coolant temperature), the engine outlet coolant temperature, and the target value of the engine outlet coolant temperature. The radiator outlet coolant temperature is computed based on a detection signal of the radiator coolant temperature sensor 9.

The instructed opening size Afin is determined from the basic instructed opening size Abse and the feedback correction value h in accordance with the equation (1). The opening size of the flow control valve 7 is thus controlled depending on the determination of the instructed opening size Afin such that the engine outlet temperature becomes close to the target value.

The target value of the engine outlet coolant temperature is selected to be, for example, 100 degrees Celsius, 90 degrees Celsius, or 80 degrees Celsius, depending on the operation state of the engine 1. For example, the target value is selected to be 100 degrees Celsius when the engine 1 is in a normal operation state. The target value is selected to be 90 degrees Celsius when the engine 1 generates less heat, or, for example, when the engine 1 is in an idling state. The target value is selected to be 80 degrees Celsius when it is preferred that the coolant temperature be minimized, or, for example, when the engine load is relatively high.

That is, the control mode of the flow control valve 7 is changed among the feedback control mode with the target value of 100 degrees Celsius, the feedback control mode with the target value of 90 degrees Celsius, and the feedback control mode with the target value of 80 degrees Celsius, in accordance with the operation state of the engine.

When the control mode of the flow control valve 7 is changed among the full opening control mode, the full closing control mode, and the feedback control modes with different target values for the engine outlet coolant temperature, the flow control valve 7 is subjected to transitional controlling. The transitional controlling of the flow control valve 7 will hereafter be described with reference to the flowcharts of FIGS. 2 and 3, which shows a transitional control routine. The routine is performed by interruption of the electronic control unit 8 at predetermined time intervals.

In this embodiment, when the control mode of the flow control valve 7 is changed from one control mode to another, the transitional controlling is performed in accordance with a selected one of different procedures depending on the current condition of the engine. In other words, a suitable transitional control procedure is selected from the different procedures, depending on from which one to which one the control mode of the flow control valve 7 is changed, as well as the purpose of switching of the control modes. This makes it possible to select and perform a transitional control procedure optimal for the current condition of the engine, when the control mode of the flow control valve 7 is changed from one mode to another. The transitional controlling is thus performed always appropriately, regardless of the condition of the engine.

Figure 2:
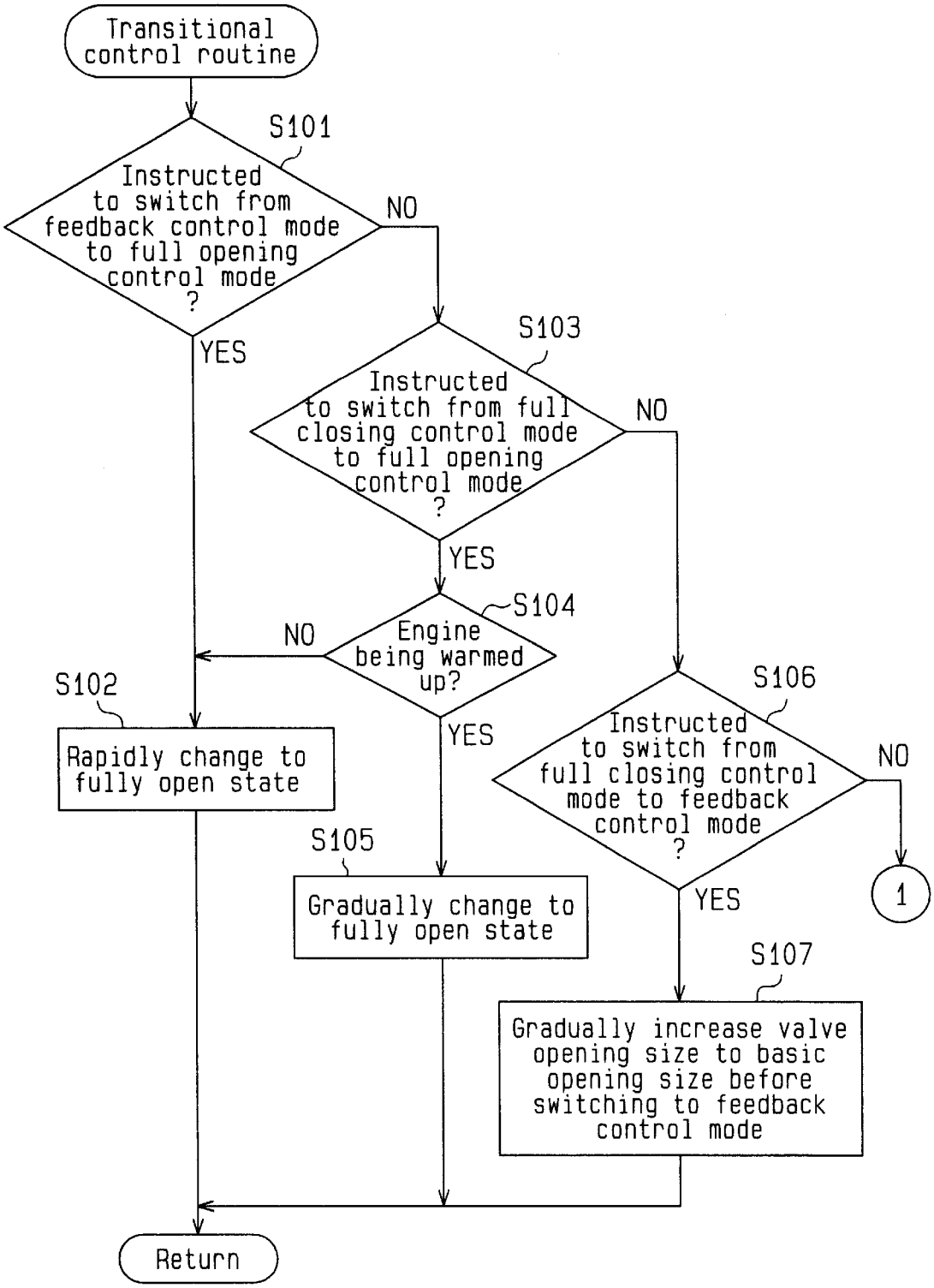
FIG. 2 is a flowchart indicating a transitional control procedure for changing the control mode of a flow control valve from one control mode to another.

In the transitional control routine, referring to FIG. 2, it is judged whether or not an instruction has been generated to change the control mode of the flow control valve 7 from one of the feedback control modes to the full opening control mode (in step S101). The instruction is generated when a problem occurs in the engine cooling system. If the judgment of S101 is positive, the flow control valve 7 is subjected to a transitional control procedure in which the opening size of the flow control valve 7 is rapidly changed to the size corresponding to the fully open state (in step S102). This quickly lowers the temperature of the coolant flowing to the engine 1, thus minimizing disadvantageous effects that are otherwise caused by the problem in the engine cooling system.

In contrast, if the judgment of S101 is negative, it is judged whether or not an instruction has been generated to change the control mode of the flow control valve 7 from the full closing control mode to the full opening control mode (in step S103). The instruction is generated not only when the engine cooling system has a problem but also immediately after the engine 1 is started. Thus, if the judgment of S103 is positive, it must be judged whether the engine 1 is being warmed up, or has been started immediately before (in step S104). If the judgment of S104 is positive, it is indicated that the instruction of S103 is not based on a problem of the engine cooling system. In this case, a transitional control procedure in which the opening size of the flow control valve 7 is gradually changed to a size corresponding to the fully open state is performed (in step S105).

This suppresses a rapid increase in the flow of the coolant that flows to the engine 1 after having been cooled by the radiator 4. A quick change of the temperature of the coolant flowing to the engine 1, which is disadvantageous to controlling of the coolant temperature, is thus avoided. In contrast, if the judgment of S104 is negative, or when it is indicated that the instruction of S103 is based on a problem of the engine cooling system, the procedure of S102, which has been described, is conducted.

If the judgment of S103 is negative, it is judged whether or not an instruction has been generated to change the control mode of the flow control valve 7 from the full closing control mode to one of the feedback control modes (in step S106). The instruction is generated when the flow control valve 7 is held in the fully closed state to warm up the engine 1 and the engine outlet coolant temperature reaches a value at which the flow control valve 7 may be subjected to feedback controlling. If the judgment of S106 is positive, a transitional control procedure of step S107 is performed. More specifically, in S107, the opening size of the flow control valve 7 is gradually increased to the aforementioned basic instructed opening size Abse before changing the control mode of the flow control valve 7 to one of the feedback control modes. This suppresses a rapid increase of the opening size of the flow control valve 7 when the feedback controlling is initiated, which otherwise leads to a quick change of the temperature of the coolant flowing to the engine 1. The basic instructed opening size Abse, which is the target opening size of the flow control valve 7 in the transitional control procedure, is obtained based on the engine speed, the engine load, and the target value of the engine outlet coolant temperature in the feedback control mode (in this embodiment, 100 or 90 or 80 degrees Celsius).

Figure 3:
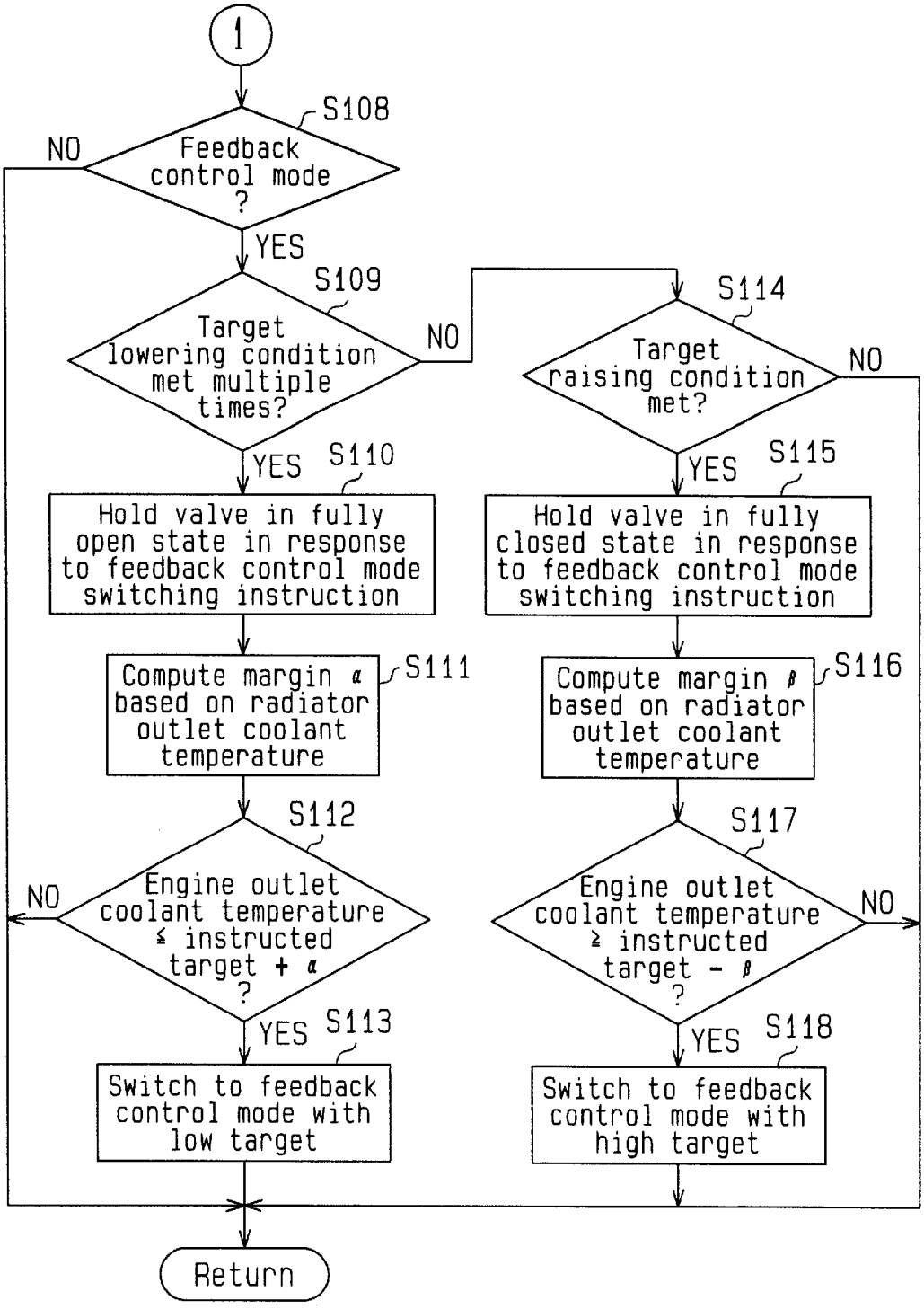
FIG. 3 is a flowchart indicating a transitional control procedure for changing the control mode of a flow control valve from one control mode to another.

If the judgment of S106 is negative, the routine proceeds to step S108 (FIG. 3). In S108, it is judged whether or not the flow control valve 7 is maintained in one of the feedback control modes. If the judgment is positive, it is judged whether or not a condition for lowering the target value of the engine outlet coolant temperature has been satisfied for multiple times (in step S109). The target value of the engine outlet coolant temperature need be lowered, for example, under the following circumstances:

The operation of the engine 1 has been changed from the normal operation state to the idling state, thus making it necessary to lower the target value from 100 degrees Celsius to 90 degrees Celsius;

The operation of the engine 1 has been changed from the normal operation state to the high load state, thus making it necessary to lower the target value from 100 degrees Celsius to 80 degrees Celsius;

The operation of the engine 1 has been changed from the idling state to the high load state, thus making it necessary to lower the target value from 90 degrees Celsius to 80 degrees Celsius.

Accordingly, the judgment of S109 becomes positive if any one of the following three conditions has been met consecutively for multiple times:

[1] The operation of the engine 1 has been changed from the normal operation state to the idling state;

[2] The operation of the engine 1 has been changed from the normal operation state to the high load state; and

[3] The operation of the engine 1 has been changed from the idling state to the high load state.

When the judgment of S109 is positive, an instruction is generated to change the control mode of the flow control valve 7 from one feedback control mode to another. More specifically, it may be instructed that the control mode of the flow control valve 7 be changed from the feedback control mode in which the target value is 100 degrees Celsius to the feedback control mode in which the target value is 90 or 80 degrees Celsius. Alternatively, it may be instructed that the control mode of the flow control valve 7 be changed from the feedback control mode in which the target value is 90 degrees Celsius to the feedback control mode in which the target value is 80 degrees Celsius.

In response to the instruction, a transitional control procedure of steps S110 to S113 is performed. According to the procedure, the control mode of the flow control valve 7 is changed from a feedback control mode in which the target value is relatively large to a feedback control mode in which the target value is relatively small.

The transitional control procedure will hereafter be explained with reference to the timing charts of FIGS. 4(*a*) and 4(*b*). FIG. 4(*a*) and FIG. 4(*b*) respectively indicates variation of the engine outlet coolant temperature and variation of the opening size of the flow control valve 7 when the control mode of the flow control valve 7 is changed from the feedback control mode in which the target value is 100 degrees Celsius to the feedback control mode in which the target value is 90 degrees Celsius.

In response to an instruction to change the control mode of the flow control valve 7 from the feedback control mode with the target value of 100 degrees Celsius to the feedback control mode with the target value of 90 degrees Celsius, the flow control valve 7 is first fully opened and then held in this state, with reference to FIG. 4(*b*) (S110). This rapidly lowers the engine outlet coolant temperature, as indicated in FIG. 4(*a*). When the engine outlet coolant temperature drops to a value larger than the instructed target value, 90 degrees Celsius, by a predetermined margin $\alpha$, the control mode of the flow control valve 7 is changed to the feedback control mode with the target value of 90 degrees Celsius.

Even if the control mode of the flow control valve 7 is changed to the feedback control mode with the target value of 90 degrees Celsius immediately after the instruction is generated, the opening size of the flow control valve 7 is only gradually increased by the feedback controlling. Thus, a relatively long time is needed for lowering the engine outlet coolant temperature from 100 degrees Celsius to 90 degrees Celsius. This lowers the controlling reliability of the engine outlet coolant temperature with respect to the target value. However, the above-described transitional control procedure solves this problem and improves the controlling reliability of the engine outlet coolant temperature with respect to the target value.

The same effects are obtained when the control mode of the flow control valve 7 is changed from the feedback control mode with the target value of 100 degrees Celsius to the feedback control mode with the target value of 90 degrees Celsius, or from the feedback control mode with the target value of 90 degrees Celsius to the feedback control mode with the target value of 80 degrees Celsius.

Further, the timing at which the control mode of the flow control valve 7 in the fully open state is changed to the feedback control mode with the relatively small target value is varied in relation to the margin $\alpha$. The margin $\alpha$ is computed based on the radiator outlet coolant temperature (S111 of FIG. 3), such that the margin $\alpha$ becomes gradually greater as the radiator outlet coolant temperature is lowered. More specifically, so-called "undershoot" tends to occur more often as the radiator outlet coolant temperature becomes gradually lower. This may lower the controlling reliability of the engine outlet coolant temperature with respect to the target value immediately after the control mode of the flow control valve 7 is changed to the feedback control mode with the relatively small target value. However, in this embodiment, the problem is suppressed by gradually increasing the margin a as the radiator outlet coolant temperature becomes lower.

As described, when the flow control valve 7 is held in the fully open state and the engine outlet coolant temperature becomes lower than or equal to the value larger than the instructed target value (90 or 80 degrees Celsius) by the margin $\alpha$ (S112: YES), the control mode of the flow control valve 7 is changed to the feedback control mode in which the target value is relatively small (in step S113).

In contrast, if the judgment of S109 of the transitional control routine is negative, it is judged whether or not a condition for raising the target value of the engine outlet coolant temperature has been satisfied (in step S114). The target value of the engine outlet coolant temperature need be raised, for example, under the following circumstances:

The operation of the engine 1 has been changed from the idling state to the normal operation state, thus making it necessary to raise the target value from 90 degrees Celsius to 100 degrees Celsius;

The operation of the engine 1 has been changed from the high load state to the normal operation state, thus making it necessary to raise the target value from 80 degrees Celsius to 100 degrees Celsius;

The operation of the engine 1 has been changed from the high load state to the idling state, thus making it necessary to raise the target value from 80 degrees Celsius to 90 degrees Celsius.

Accordingly, the judgment of S114 becomes positive if any one of the following three conditions has been met even for once:

[4] The operation of the engine 1 has been changed from the idling state to the normal operation state;

[5] The operation of the engine 1 has been changed from the high load state to the normal operation state; and

[6] The operation of the engine 1 has been changed from the high load state to the idling state.

If the judgment of S114 is positive, an instruction is generated to change the control mode of the flow control valve 7 from one feedback control mode to another. More specifically, it may be instructed that the control mode of the flow control valve 7 be changed from the feedback control mode in which the target value is 90 degrees Celsius to the feedback control mode in which the target value is 100 degrees Celsius. Alternatively, it may be instructed that the control mode of the flow control valve 7 be changed from the feedback control mode in which the target value is 80 degrees Celsius to the feedback control mode in which the target value is 90 or 100 degrees Celsius.

In response to the instruction, a transitional control procedure in steps S115 to S118 is performed. According to the procedure, the control mode of the flow control valve 7 is changed from a feed back control mode in which the target value is relatively small to a feedback control mode in which the target value is relatively.

The transitional control procedure will hereafter be explained with reference to the timing charts of FIGS. 5(*a*) and 5(*b*). FIG. 5(*a*) and FIG. 5(*b*) respectively indicate variation of the engine outlet coolant temperature and variation of the opening size of the flow control valve 7 when the control mode of the flow control valve 7 is changed from the feedback control mode in which the target value is 90 degrees Celsius to the feedback control mode in which the target value is 100 degrees Celsius.

In response to the instruction to change the control mode of the flow control valve 7 from the feedback control mode with the target value of 90 degrees Celsius to the feedback control mode with the target value of 100 degrees Celsius, the flow control valve 7 is first fully closed and then held in this state, with reference to FIG. 5(*b*) (in step S115). This rapidly raises the engine outlet coolant temperature, as indicated in FIG. 5(*a*). When the engine outlet coolant temperature rises to a value smaller than the instructed target temperature, 100 degrees Celsius, by a predetermined margin β, the control mode of the flow control valve 7 is changed to the feedback control mode with the target value of 100 degrees Celsius.

Even if the control mode of the flow control valve 7 is changed to the feedback control mode with the target value of 100 degrees Celsius immediately after the instruction is generated, the opening size of the flow control valve 7 is only gradually decreased in accordance with the feedback controlling. Thus, a relatively long time is needed for raising the engine outlet coolant temperature from 90 degrees Celsius to 100 degrees Celsius. This lowers the controlling reliability of the engine outlet coolant temperature with respect to the target value. However, the above-described transitional control procedure solves this problem and improves the controlling reliability of the engine outlet coolant temperature with respect to the target value.

The same effects are obtained when the control mode of the control valve 7 is changed from the feedback control mode with the target value of 80 degrees Celsius to the feedback control mode with the target value of 90 or 100 degrees Celsius.

Further, the timing at which the control mode of the flow control valve 7 in the fully closed state is changed to the feedback control mode in which the target value is relatively large is varied in relation to the margin β. The margin β0 is computed based on the radiator outlet coolant temperature (in step S116), such that the margin β becomes gradually greater as the radiator outlet coolant temperature is increased. More specifically, the overshoot tends to occur more often as the radiator outlet coolant temperature becomes higher. This may lower the controlling reliability of the engine outlet coolant temperature with respect to the target value immediately after the control mode of the flow control valve 7 is changed to a feedback control mode with a relatively large target value. However, in this embodiment, the problem is suppressed by gradually increasing the margin β as the radiator outlet coolant temperature becomes higher.

As described, when the flow control valve 7 is held in the fully closed state and the engine outlet coolant temperature becomes higher than or equal to the value smaller than the instructed target value (100 or 90 degrees Celsius) by the margin β (S117: YES), the control mode of the flow control valve 7 is changed to the feedback control mode in which the target value is relatively large (in step S118).

The illustrated embodiment has the following effects.

(1) The flow control valve 7 is subjected to the transitional controlling when the control mode of the flow control valve 7 is changed among the full opening control mode, the full closing control mode, and the different feedback control modes that set different target values for the engine outlet coolant temperature. The transitional controlling is performed in accordance with a selected one of the different transitional control procedures, depending on the current condition of the engine. This makes it possible to select and conduct an optimal transitional control procedure for the current condition of the engine. The transitional controlling is thus appropriately performed, regardless of the condition of the engine.

(2) If the cooling system has a problem, an instruction is generated to change the control mode of the flow control valve 7 from one of the feedback control modes or the full closing control mode to the full opening control mode. In this case, the transitional control procedure in which the opening size of the flow control valve 7 is rapidly changed to the size corresponding to the fully open state is selected and conducted. In other words, in the case of a problem occurring in the engine cooling system, or when it is preferred that the coolant flow in the radiator line 5 be rapidly increased, the opening size of the flow control valve 7 is rapidly changed to the size corresponding to the fully open state. This quickly lowers the temperature of the coolant flowing to the engine 1. Accordingly, disadvantages caused by the problem are minimized.

(3) In response to an instruction to change the control mode of the flow control valve 7 from the full closing control mode to the full opening control mode, it is judged whether or not the engine 1 is being warmed up. If the judgment is positive, it is indicated that the instruction has been generated due to the warming up of the engine 1, not for a problem occurring in the engine cooling system. In this case, it is preferred that the coolant flow in the radiator line 5 be increased gradually. Thus, the transitional control procedure in which the opening size of the flow control valve 7 is gradually changed to the size corresponding to the fully open state is performed. This suppresses a rapid increase in the flow of the coolant that flows to the engine 1 after having been cooled by the radiator 4. A quick change of the temperature of the coolant flowing to the engine 1, which causes disadvantages in controlling of the coolant temperature, is thus avoided.

(4) When the control mode of the flow control valve 7 is changed from the full closing control mode to one of the feedback control modes, the transitional control procedure in which the opening size of the flow control valve 7 is gradually increased to the basic instructed opening size Abse is selected and conducted. The feedback controlling is started only after completion of the gradual increasing of the opening size of the flow control valve 7. This suppresses a rapid increase of the opening size of the flow control valve 7 at the start of the feedback controlling. A quick change of the temperature of the coolant flowing to the engine 1, which causes disadvantages in controlling of the coolant temperature, is thus avoided.

(5) When the control mode of the flow control valve 7 is changed from a feedback control mode in which the target value is relatively large to a feedback control mode in which the target value is relatively small, the transitional controlling is performed by the following procedure. That is, the flow control valve 7 is first fully opened and then subjected to the feedback control mode with the relatively small target value. More specifically, the flow control valve 7 is temporarily held in the fully open state to lower the engine outlet coolant temperature. When the engine outlet coolant temperature drops to the value larger than the instructed target value, or the relatively small target value, by the margin α, the control mode of the flow control valve 7 is changed to the feedback control mode with the relatively small target value. The engine outlet coolant temperature is then lowered quickly to the target value of the instructed feedback control mode. This improves the controlling reliability of the engine outlet coolant temperature with respect to the target value immediately after switching of the feedback control modes of the flow control valve 7.

(6) The margin α is a variable value that is gradually increased as the radiator outlet coolant temperature becomes lower. This prevents the controlling reliability of the engine outlet coolant temperature with respect to the target value from being lowered immediately after the control mode of the flow control valve 7 is changed to the feedback control mode with the relatively small target value. More specifically, the undershoot tends to occur more often in the feedback controlling as the radiator outlet coolant temperature becomes lower. However, since the margin α is varied as described, lowering of the controlling reliability of the engine outlet coolant temperature, which is otherwise caused by the undershoot, is suppressed.

(7) Further, the control mode of the flow control valve 7 is changed from the feedback control mode with the relatively large target value to the feedback control mode with the relatively small target value, only after any one of the aforementioned conditions [1] to [3] has been met consecutively for multiple times. The control mode of the flow control valve 7 is thus prevented from being changed from one feedback control mode to another excessively often. This suppresses lowering of the controlling reliability of the engine outlet coolant temperature with respect to the target value.

(8) When the control mode of the flow control valve 7 is changed from a feedback control mode in which the target value is relatively small to a feedback control mode in which the target value is relatively large, the transitional controlling is performed by the following procedure. That is, the flow control valve 7 is first fully closed and then subjected to the feedback control mode with the relatively large target value. More specifically, the flow control valve 7 is temporarily held in the fully closed state to raise the engine outlet coolant temperature. When the engine outlet coolant temperature rises to the value smaller than the instructed target value, or the relatively large target value, by the margin β, the control mode of the flow control valve 7 is changed to the feedback control mode with the relatively large target value. The engine outlet coolant temperature is then raised quickly to the target value of the instructed feedback control mode. This improves the controlling reliability of the engine outlet coolant temperature with respect to the target value immediately after switching of the feedback control modes of the flow control valve 7.

(9) The margin β is a variable value that is gradually increased as the radiator outlet coolant temperature becomes higher. This prevents the controlling reliability of the engine outlet coolant temperature from being lowered immediately after the control mode of the flow control valve 7 is changed to the feedback control mode with the relatively large target value. More specifically, the overshoot tends to occur more often in the feedback controlling as the radiator outlet coolant temperature becomes higher. However, since the margin β is varied as described, lowering of the controlling reliability of the engine outlet coolant temperature, which is otherwise caused by the overshoot, is suppressed.

The illustrated embodiment may be modified as follows.

In the illustrated embodiment, the control mode of the flow control valve 7 is changed from a feedback control mode with a relatively large target value to a feedback control mode with a relatively small target value, only after any one of the conditions [1] to [3] has been consecutively met for multiple times. However, the present invention is not restricted to the illustrated embodiment. For example, the feedback control modes of the flow control valve 7 may be switched from one mode to another when any one of the conditions [1] to [3] is met only once.

The margins α and β do not necessarily have to be variable.

In the illustrated embodiment, when the control mode of the flow control valve 7 is changed from one feedback control mode to another, the flow control valve 7 is temporarily held in the fully open or closed state, until the engine outlet coolant temperature reaches the value larger than the instructed target value by the margin a or the value smaller than the instructed target value by the margin β. However, the present invention is not restricted to the illustrated embodiment. For example, the flow control valve 7 may be temporarily held in the fully open or closed state for the time that is calculated based on the radiator outlet coolant temperature. More specifically, the time for which the flow control valve 7 is held in the fully open or closed state is selected depending on the radiator outlet coolant temperature, such that the engine outlet coolant temperature reaches the instructed target value when the selected time elapses.

The present examples and embodiments are to be considered as illustrative and not restrictive and the invention is not to be limited to the details given herein, but may be modified within the scope and equivalence of the appended claims.

What is claimed is:

1. An engine cooling system, comprising:

a coolant circuit, which extends through an engine, wherein coolant flows in the coolant circuit;

a radiator, which is located in the coolant circuit, wherein the radiator cools the coolant that flows in the coolant circuit;

a flow control valve, wherein the flow control valve regulates the amount of the coolant that passes through the radiator; and a controller, which controls the flow control valve for adjusting the temperature of the coolant that flows in the engine, wherein the controller controls the flow control valve in accordance with a control mode selected from different types of control modes, and wherein the controller performs a transitional control procedure selected from different types of transitional control procedures when switching from one control mode to another.

2. The system according to claim 1, wherein the controller selects the transitional control procedure to be performed depending on which control modes are performed before and after the control mode switching.

3. The system according to claim 2, wherein the control modes include a full opening control mode in which the flow control valve is maintained in a fully open state, a full closing control mode in which the flow control valve is maintained in a fully closed state, and a feedback control mode in which the opening size of the flow control valve is controlled in a feedback manner such that the temperature of the coolant that flows in the engine seeks a predetermined target value.

4. The system according to claim 3, wherein the feedback control mode is one of different types of control modes that set different target temperatures for the coolant.

5. The system according to claim 1, wherein the controller selects the transitional control procedure to be performed depending on the current condition of the engine, when switching from one control mode to another.

6. The system according to claim 1, wherein the different types of transitional control procedures include a control procedure in which the opening size of the flow control valve is gradually changed to a size suitable for the control mode to be performed after the control mode switching, and a control procedure in which the opening size of the flow control valve is rapidly changed to a size suitable for the control mode to be performed after the control mode switching.

7. The system according to claim 1, wherein the different types of control modes include a full opening control mode in which the flow control valve is maintained in a fully open state, and the controller selects the transitional control procedure to be performed depending on the current condition of the engine, when switching to the full opening control mode.

8. The system according to claim 7, wherein the different types of transitional control procedures include a transitional control procedure in which the opening size of the flow control valve is gradually changed to a size corresponding to the fully open state, and a transitional control procedure in which the opening size of the flow control valve is rapidly changed to the size corresponding to the fully open state.

9. The system according to claim 7, wherein the controller selects and executes a transitional control procedure in which the opening size of the flow control valve is gradually changed to a size corresponding to the fully open state if the engine is being warmed up, when switching to the full opening control mode.

10. The system according to claim 7, wherein the controller selects and executes a transitional control procedure in which the opening size of the flow control valve is rapidly changed to a size corresponding to the fully open state if the cooling system has a problem, when switching to the full opening control mode.

11. The system according to claim 1, wherein:

the different types of control modes include a feedback control mode in which the opening size of the flow control valve is controlled in a feedback manner such that the temperature of the coolant that flows in the engine seeks a predetermined target value;

the controller in the feedback control mode computes a target opening size of the flow control valve by correcting a basic opening size in accordance with a correction value, the basic opening size being determined depending on the operational state of the engine, the correction value being determined depending on the temperature of the coolant; and the controller selects and executes a transitional control procedure in which the opening size of the flow control valve is gradually changed to the basic opening size, when switching to the feedback control mode.

12. The system according to claim 1, wherein the different types of control modes include a full closing control mode in which the flow control valve is maintained in a fully closed state, and the controller selects the transitional control procedure to be performed depending on the current condition of the engine, when switching from the full closing control mode to a different control mode.

13. The system according to claim 12, wherein the different types of transitional control procedures include a transitional control procedure in which the opening size of the flow control valve is gradually changed from a size corresponding to the fully closed state to a size suitable for the control mode to be performed after the control mode switching, and a transitional control procedure in which the opening size of the flow control valve is rapidly changed from the size corresponding to the fully closed state to the size suitable for the control mode to be performed after the control mode switching.

14. The system according to claim 12, wherein the controller selects and executes a transitional control procedure in which the opening size of the flow control valve is gradually changed from a size corresponding to the fully closed state to a size suitable for the control mode to be performed after the control mode switching if the engine is being warmed up, when switching from the full closing control mode to the different control mode.

15. The system according to claim 12, wherein the controller selects and executes a transitional control procedure in which the opening size of the flow control valve is rapidly changed from a size corresponding to the fully closed state to a size suitable for the control mode to be performed after the control mode switching if the cooling system has a problem, when switching from the full closing control mode to the different control mode.

16. The system according to claim 1, wherein:

the different types of control modes include a feedback control mode in which the opening size of the flow control valve is controlled in a feedback manner such that the temperature of the coolant that flows in the engine seeks a predetermined target value, and a large opening size control mode in which the opening size of the flow control valve is maintained at a size larger than a size suitable for the feedback control mode; and the controller selects and executes a transitional control procedure in which the opening size of the flow control valve is rapidly changed to the size suitable for the large opening size control mode, when switching from the feedback control mode to the large opening size control mode.

17. The system according to claim 16, wherein the controller switches from the feedback control mode to the large opening size control mode when the cooling system has a problem.

18. The system according to claim 1, wherein:

the control modes include different types of feedback control modes;

in each of the feedback control modes, the controller controls the opening size of the flow control valve in a feedback manner such that the temperature of the coolant flowing in the engine seeks a predetermined target value that is different from the target values of the other feedback control modes; and the controller selects the transitional control procedure to be performed depending on which feedback control modes are performed before and after the control mode switching.

19. The system according to claim 18, wherein the different types of feedback control modes include at least a first feedback control mode and a second feedback control mode, and the target temperature of the coolant in the first feedback control mode is higher than the target temperature of the coolant in the second feedback control mode.

20. The system according to claim 19, wherein the controller selects and executes a transitional control procedure in which the opening size of the flow control valve is changed first to a size corresponding to a fully open state and then to a size suitable for the second feedback control mode, when switching from the first feedback control mode to the second feedback control mode.

21. The system according to claim 20, wherein, in the selected transitional control procedure, the controller maintains the flow control valve in the fully open state until the temperature of the coolant drops to a value larger than the target temperature of the second feedback control mode by a predetermined margin.

22. The system according to claim 19, wherein the controller switches from the first feedback control mode to the second feedback control mode after a prescribed condition based on the operational state of the engine has been met consecutively for multiple times.

23. The system according to claim 19, wherein the controller selects and executes a transitional control procedure in which the opening size of the flow control valve is changed first to a size corresponding to a fully closed state and then to a size suitable for the first feedback control mode, when switching from the second feedback control mode to the first feedback control mode.

24. The system according to claim 23, wherein, in the selected transitional control procedure, the controller maintains the flow control valve in the fully closed state until the temperature of the coolant rises to a value smaller than the target temperature of the first feedback control mode by a predetermined margin.

25. An engine cooling system, comprising:

a coolant circuit, which extends through an engine, wherein coolant flows in the coolant circuit;

a radiator, which is located in the coolant circuit, wherein the radiator cools the coolant that flows in the coolant circuit;

a flow control valve, wherein the flow control valve regulates the amount of the coolant that passes through the radiator; and a controller, which controls the flow control valve for adjusting the temperature of the coolant that flows in the engine, wherein the controller controls the flow control valve in accordance with a control mode selected from different types of control modes, the control modes include a first control mode in which the opening size of the flow control valve is maintained at a predetermined size, a second control mode in which the opening size of the flow control valve is maintained at a size smaller than the size of the first control mode, and a feedback control mode in which the opening size of the flow control valve is controlled in a feedback manner such that the temperature of the coolant that flows in the engine seeks a predetermined target value;

the controller controls the flow control valve in accordance with a transitional control procedure selected from different types of transitional control procedures when switching from one control mode to another; and the controller selects the transitional control procedure to be performed depending on which control modes are performed before and after the control mode switching and/or the current condition of the engine.

26. A method for controlling an engine cooling system, wherein the system includes a coolant circuit that extends through an engine, the method comprising:

cooling coolant that flows in the coolant circuit with a radiator located in the coolant circuit;

regulating the amount of the coolant that passes through the radiator with a flow control valve;

controlling the flow control valve in accordance with a control mode selected from different types of control modes; and controlling the flow control valve in accordance with a transitional control procedure selected from different types of transitional control procedures, when switching from one control mode to another.

* * * * *